US008377348B1

(12) United States Patent
Montemayor et al.

(10) Patent No.: US 8,377,348 B1
(45) Date of Patent: Feb. 19, 2013

(54) CRACK REPAIR FOR PAVED SURFACES AND RECREATIONAL COURTS

(75) Inventors: Robert Mark Montemayor, Toccoa, GA (US); Michael Imbornone, Woodstock, GA (US)

(73) Assignee: Crackspan, Inc., Woodstock, GA (US)

( * ) Notice: Subject to any disclaimer, the term of this patent is extended or adjusted under 35 U.S.C. 154(b) by 372 days.

(21) Appl. No.: 12/723,863

(22) Filed: Mar. 15, 2010

Related U.S. Application Data

(60) Provisional application No. 61/159,900, filed on Mar. 13, 2009.

(51) Int. Cl.
*B29C 73/00* (2006.01)
*B29C 73/14* (2006.01)

(52) U.S. Cl. ..... 264/36.1; 404/72; 404/75

(58) Field of Classification Search ..... 264/36.1; 404/72, 75

See application file for complete search history.

(56) References Cited

U.S. PATENT DOCUMENTS

| | | | | |
|---|---|---|---|---|
| 3,663,350 | A | 5/1972 | Stokes | |
| 3,932,051 | A | 1/1976 | Cleary | |
| 5,405,213 | A * | 4/1995 | O'Connor | 404/77 |
| 5,464,304 | A * | 11/1995 | Dittmar | 404/75 |
| 6,450,729 | B1 | 9/2002 | Clapp | |
| 7,396,185 | B2 | 7/2008 | Rossi | |

* cited by examiner

*Primary Examiner* — Brent O'Hern
(74) *Attorney, Agent, or Firm* — Hope Baldauff Hartman, LLC

(57) ABSTRACT

Concepts and technologies described herein provide for the repair of a crack in a paved surface such as a recreational court. According to one aspect of the disclosure provided herein, a crack is filled with a patching compound. A non-bonding soft coat is applied to the surface over the patching compound. A bond coat is applied to the surface adjacent to opposing sides of the soft coat. A membrane overlaid onto the soft coat, overlapping the bond coat on both sides of the membrane. A top coat is applied to the membrane, overlapping onto the bond coat. A finishing coat is applied to the top coat.

12 Claims, 5 Drawing Sheets

CRACK REPAIR FOR PAVED SURFACES AND RECREATIONAL COURTS

CROSS-REFERENCE TO RELATED APPLICATIONS

This application claims priority to U.S. Provisional Patent Application No. 61/159,900, filed on Mar. 13, 2009, and entitled "Crack Repair for Paved Surfaces and Recreational Courts," which is expressly incorporated herein by reference in its entirety.

BACKGROUND

Cracks that develop in paved surfaces can form due to a variety of causes. These causes may include movement of the surface or in the ground below the surface. The causes may also include weather such as rain or snow. Cracks in recreational surfaces such as tennis courts, basketball courts, other courts, paved tracks, and others may render the surfaces less functional or aesthetically impaired.

Attempts to repair surface cracks often include adhering a patch or other layer over the crack and onto the surface surrounding the crack. Unfortunately, bonding the patch layer to the surface around the crack may be problematic. Such bonding will usually eventually result in breaking or tearing of the patch layer as the crack flexes or expands and contracts due to weather and thermal fluctuations. Additionally, flexible materials have been used to repair cracks in an effort to accommodate the expansion and contraction of the surface being repaired. However, contraction of the repaired surface typically causes the flexible repair material to flex upwards, created a raised surface over the crack repair site that is not acceptable for most sports or activities being conducted on the repaired court.

It is with respect to these considerations and others that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Concepts and technologies described herein provide for the repair of a crack in a paved surface such as a recreational court. According to one aspect of the disclosure provided herein, a method for repairing a crack includes filling the crack with a patching compound until the patching compound is substantially flush with the surface. A non-bonding soft coat is applied over the patching compound. A bond coat is then applied to the surface on both sides of the soft coat. A membrane is overlaid onto the soft coat and bond coat so that opposing edges of the membrane are positioned within the bond coat. A top coat is applied over the membrane so that the top coat overlaps the edges of the membrane and overlays the bond coat. A finishing material is applied over the top coat.

According to another aspect, a crack repair system includes a patching compound, a non-bonding soft coat, a bond coat, a membrane, a top coat, a finishing material, and instructions for repairing the crack. The instructions direct a user to fill the crack with the patching compound until the patching compound is substantially flush with the surface, apply a non-bonding soft coat over the patching compound, apply a bond coat to the surface on both sides of the soft coat, overlay a membrane onto the soft coat and bond coat so that opposing edges of the membrane are positioned within the bond coat, apply a top coat over the membrane so that the top coat overlaps the edges of the membrane and overlays the bond coat, and apply a finishing material over the top coat.

According to yet another aspect of the disclosure, a crack repair includes a patching compound fill layer, a non-bonding soft coat layer, a bond coat layer, a membrane layer, a top coat layer, and a finishing layer. The patching compound layer fills a crack in a surface. The non-bonding soft coat layer overlays the patching compound fill layer. The bond coat layer is positioned next to opposing edges of the non-bonding soft coat layer and is adhered to the surface. The membrane layer overlays the non-bonding soft coat layer and the bond coat layer, and is adhered to the bond coat layer. The top coat layer overlays and is adhered to the membrane layer and the bond coat layer. The finishing material layer overlays the top coat layer.

The features, functions, and advantages that have been discussed can be achieved independently in various embodiments of the present disclosure or may be combined in yet other embodiments, further details of which can be seen with reference to the following description and drawings.

DETAILED DESCRIPTION

The following detailed description is directed to systems and methods for repairing cracks in paved surfaces and recreational courts. As discussed above, conventional court repair processes do not adequately repair the surface in a manner that is long lasting and that will adequately accommodate the expansion and contraction of the court surface as temperatures and environmental conditions change.

Previous approaches to repairing court surfaces include providing a non-adhering region around a crack, such as placing a slip sheet or slip tape over the crack prior to attaching the repair membrane. Moreover, conventional approaches have included placing a bonding coat over the crack in an attempt to prevent the repair membrane from adhering over the crack. These approaches may leave a surface, sheet, or other material within the non-adhering area around the crack that can provide a dead spot in the paved recreational surface. These dead spots may sound unusual when contacted by a ball, a foot or any other object. The dead spots may also impact the functionally of the surface.

Utilizing the concepts and technologies described herein, cracks in courts and other paved surfaces can be repaired in a manner that allows for expansion and contraction of the surface without adversely affecting the repair and in a manner that most closely preserves the intended surface characteristics without creating a dead spot associated with the crack repair. Specifically, the use of a non-bonding soft coat between a patching compound layer and a repair membrane provides an effective and inexpensive solution to surface crack repairs that may reduce undesirable effects such as dead spots.

Figure 1:
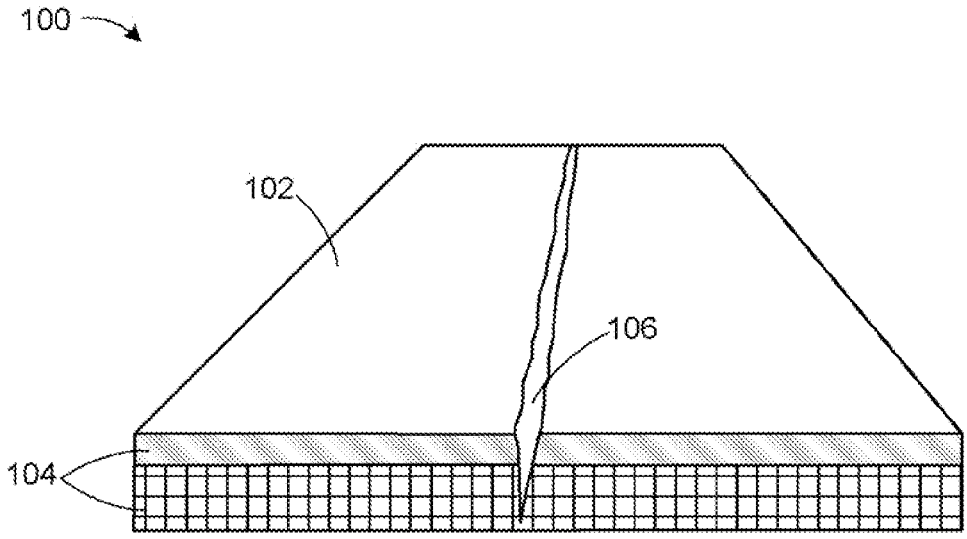
FIG. 1 is a perspective view representation of a conventional recreational court having a crack according to various embodiments presented herein.

In the following detailed description, references are made to the accompanying drawings that form a part hereof, and which are shown by way of illustration, specific embodiments, or examples. Like numerals represent like elements through the several figures. Referring now to FIG. 1, a recreational court 100 is shown. It should be understood that the embodiments disclosed herein may be described in the context of a repair to a tennis court or other recreational court 100 for the purposes of illustration. However, the concepts disclosed herein may be applied to any type of paved surface created from any type and number of layers of material.

The recreational court 100 of FIG. 1 has a top surface 102 and any number of lower layers 104. A crack 106 extends lengthwise through the top surface 102 and a portion of the lower layers 104. According to one embodiment, the first process for repairing the recreational court 100 is to clean and fill the crack 106.

Figure 2:
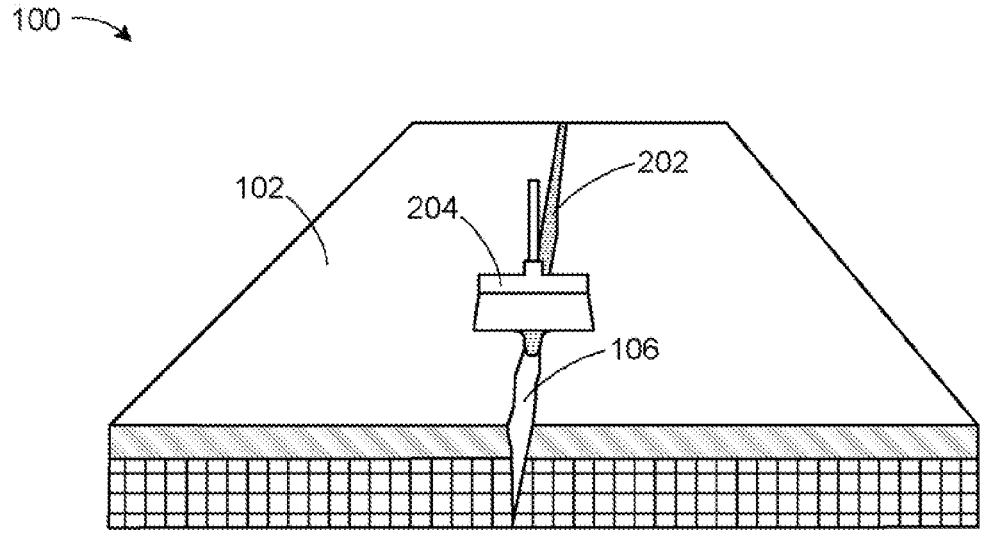
FIG. 2 is a perspective view representation of a conventional recreational court with a crack, illustrating the application of a patching compound according to various embodiments presented herein.

FIG. 2 shows the process of cleaning and filling the crack 106. After cleaning any dirt and debris from the crack 106 and surrounding area, the crack 106 may be filled with a patching compound 202. The patching compound 202 may be a latex cement patching compound, such as a mixture of latex emulsion, sand, and cement. The cement may include Portland cement. The latex cement patching compound is satisfactory for many cracks 106 that are in substantially dry areas under normal use. It should be appreciated that other patching compounds or crack fillers may be used without departing from the scope of the disclosure provided herein. For example, a hot pour asphalt material may be poured into the crack 106 as a patching compound 202, particularly in high moisture areas. An advantage to this material is that it seals off the crack 106 from moisture intrusion because it is flexible and has strong adherence properties.

Figure 3:
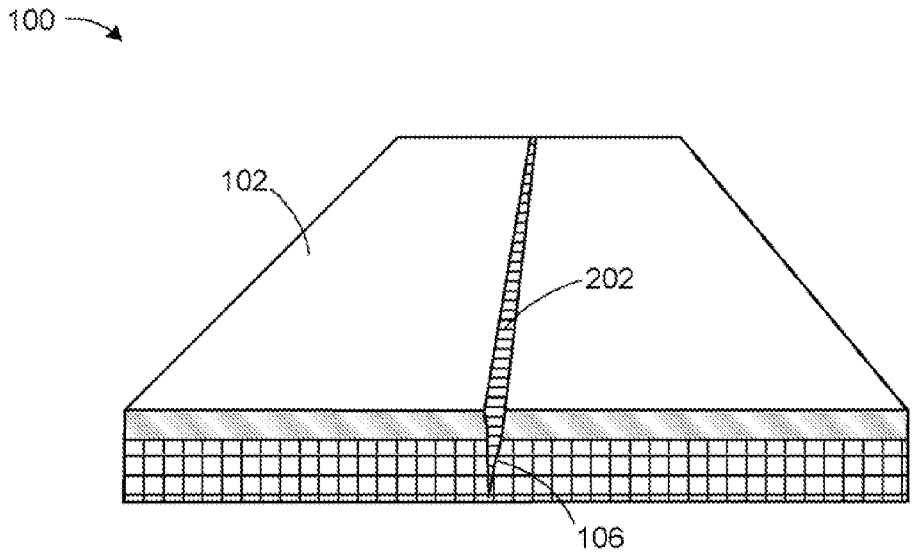
FIG. 3 is a perspective view representation of a conventional recreational court with a crack filled with patching compound according to various embodiments presented herein.

To aid in filling the crack 106, a steel trowel 204, or any other type of trowel or tool, may be used to uniformly spread the patching compound 202 and smooth the surface of the filled crack 106 so that it is substantially flush with the top surface 102. The filled crack 106 can be further scraped, sanded, and/or otherwise smoothed to create a smooth surface that is substantially coplanar with the top surface 102, as shown in FIG. 3.

Figure 4:
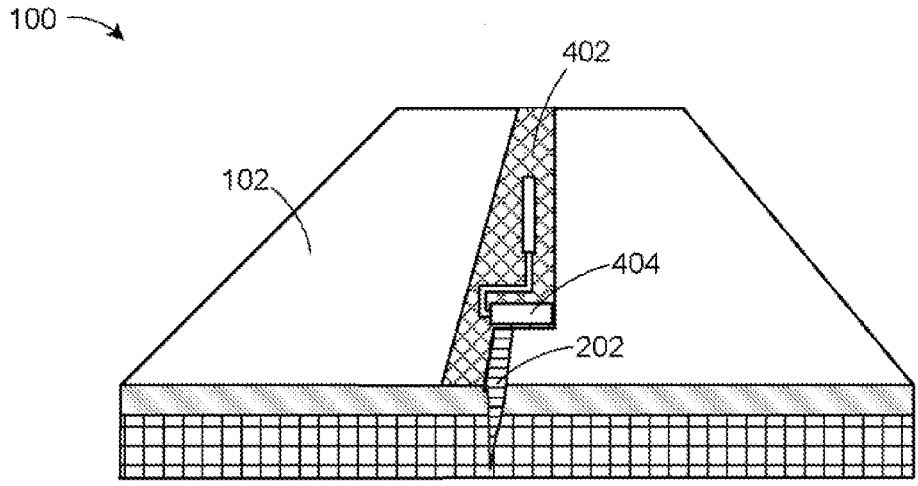
FIG. 4 is a perspective view representation of a conventional recreational court with a crack, illustrating the application of a soft coat over the filled crack according to various embodiments presented herein.

Turning to FIG. 4, after smoothing the patching compound 202, a soft coat 402 is applied over the filled crack. The soft coat 402 may be considered a non-bonding layer, or a non-bonding chalk layer or liquid chalk. The soft coat 402 may be a mixture of latex polymer and a thickener, and may additionally comprise water or other solvent. According to various embodiments, the soft coat 402 may include a pigment or colorant such as iron oxide pigment. The thickener may comprise a cellulosic thickener. The cellulosic thickener may contain cellulous, hemicellulose, other such compounds, or any combination thereof. An advantage of the soft coat 402 described herein over conventional repair techniques is that the soft coat 402 used in this process provides a non-adhering surface that will not bond to the patching compound 202 below the soft coat 402, and will also not bond to the membrane layer positioned above the soft coat 402. This ensures that the membrane (described in greater detail below) and the layers 104 around the crack 106 are able to independently expand and contract without compromising the repair.

The soft coat 402 may be applied using a roller 404, such as a 3 inch paint roller, or may be alternatively applied using a brush, or by pouring or spraying. The soft coat 402 may be applied in a strip that is substantially centered over the filled crack 106. According to one embodiment, the strip is approximately 8 inches wide. According to other embodiments, the strip is between 4-12 inches wide, or any other width as reasonable to cover the filled crack 106 and extend onto the surrounding planar top surface 102 on both sides of the crack 106.

Figure 5:
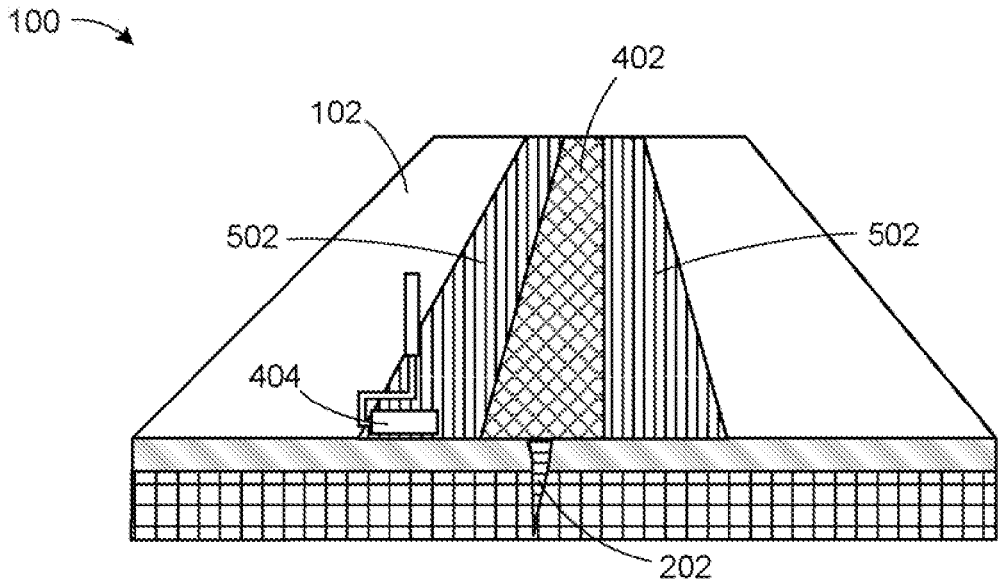
FIG. 5 is a perspective view representation of a conventional recreational court with a crack, illustrating the application of a bond coat adjacent to the soft coat according to various embodiments presented herein.

As seen in FIG. 5, after the soft coat 402 has thoroughly dried, a bond coat 502 is applied to the areas of the top surface 102 immediately adjacent to either side of the soft coat 402. These two strips of bond coat 502 will provide a means in which to adhere the membrane to the top surface 102 without adhering the membrane to the soft coat 402. According to one embodiment, the bond coat 502 is applied in approximately 12 inch strips on either side of the soft coat 402. However, it should be appreciated that the strips of bond coat 502 one either side of the soft coat 402 may be any width.

The bond coat 502 can be an elastomeric compound such as those used in the waterproofing industry. The bond coat 502 may be any other waterproofing, sealing, or adhesive compound, and may include a mixture of elastomeric material and acrylic material. One advantage to using a bond coat 502 that incorporates an elastomeric compound is to provide a barrier to water, adhering the membrane to the top surface 102 while protecting it from water damage. If water were to enter the repaired crack 106 from beneath the membrane, then the waterproof bond coat 502 will prevent the water from damaging the membrane, and specifically the adhesion between the membrane and the top surface 102.

Figure 6:
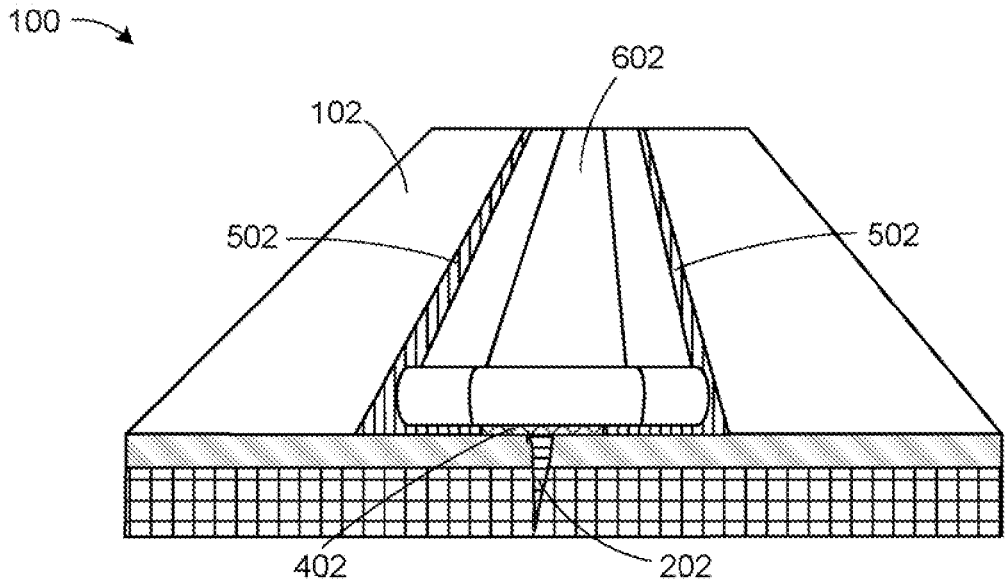
FIG. 6 is a perspective view representation of a conventional recreational court with a crack, illustrating the application of a membrane over the soft coat and bond coat according to various embodiments presented herein.

Turning to FIG. 6, the application of the membrane will be described. While the bond coat 502 is still wet, a membrane 602 may be positioned directly on top of the bond coat 502. According to one embodiment, the membrane 602 is positioned such that it spans the entire length of the crack 106 and covers approximately a 4 foot width. It should be appreciated that the membrane 602 may be subdivided into any lengths or dimensions and may be applied in adjacent panels or overlapping panels rather than unrolled from a length of material rolled on a spool as shown. For example, the membrane 602 may be any width such as 12, 24, or 48 inches according to the width of the crack and the width of bonding coat 502 strips. The membrane 602 may be a fabric such as a polyester fabric, and may be stitch-bonded.

Figure 7:
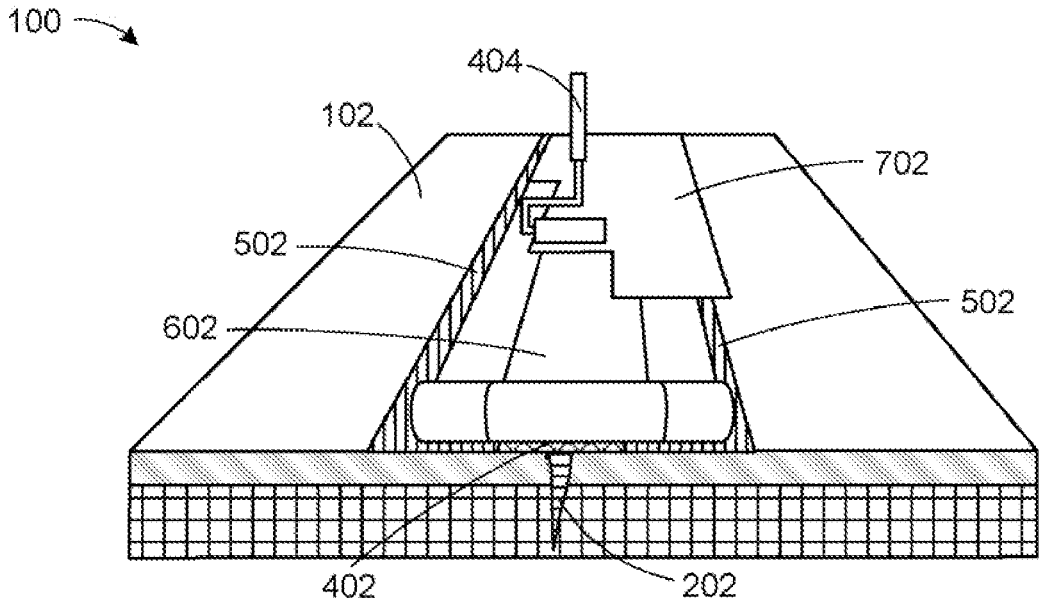
FIG. 7 is a perspective view representation of a conventional recreational court with a crack, illustrating the application of a top coat over the membrane and bond coat according to various embodiments presented herein.

Looking at FIG. 7, a top coat 702 may be applied over the upper surface of the membrane 602 that was positioned over the soft coat 402 on the filled crack 202. The top coat 702 may be applied until the fabric of the membrane 602 is thoroughly saturated, or wetted with the top coat material. The top coat 702 may be applied over the entire membrane surface including where the membrane 602 is covering the soft coat 402. The top coat 702 material may be identical to, or similar to, the bond coat 502. In doing so, the membrane 602 is fully saturated with the waterproof elastomeric bond coat 502 and sandwiched between the bond coat 502 at the outer edges of the membrane 602 where the membrane 602 is to adhere to the top surface 102 of the recreational court 100. The membrane 602 may be cut where necessary, such as to follow the direction of the crack 106. In these locations, the edges of adjacent membrane material may be overlapped. According to one embodiment, the membrane material is overlapped at least 3 inches where adjacent pieces meet.

Figure 8:
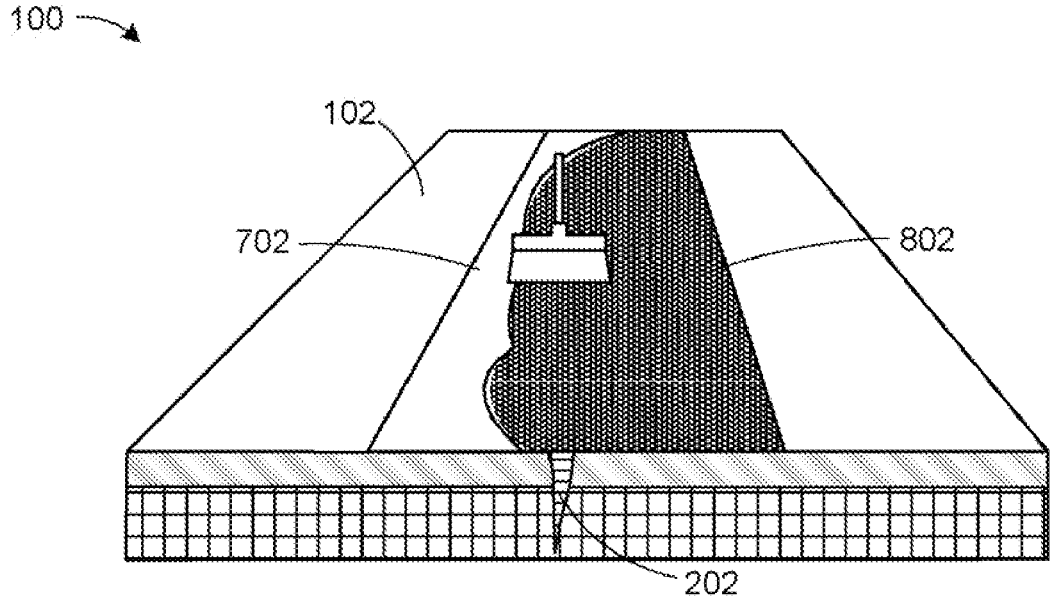
FIG. 8 is a perspective view representation of a conventional recreational court with a crack, illustrating the application of a finishing coat over the top coat according to various embodiments presented herein.

As shown in FIG. 8, after the top coat 702 has thoroughly dried, one to two coats of a finishing material 802 may be applied to the top coat 702. According to one embodiment, the finishing material 802 includes an acrylic resurfacing compound, and may comprise sand. An example of an acrylic resurfacing compound may be a sand filled, heavy-bodied acrylic slurry, such as those used in tennis court coatings. Alternatively, according to another embodiment, the finishing material 802 may include a slurry coat of a latex cement patching compound. This alternative has improved stiffness properties as compared to the acrylic slurry for preventing any bulging of the membrane 602 caused by expansion and contraction of the recreational court and/or crack repair materials.

The finishing material 802 can be applied with a squeegee, a steel or other trowel, a roller, brush, or by pouring or spraying. The finishing material 802 is applied substantially parallel to the direction of the crack repair, covering the edges of the membrane 602. According to one embodiment, the finishing material 802 is applied to overlap the edges of the membrane by 3 inches or more. It should be understood that the precise composition of the finishing material 802, as well as the application process, may depend on the specific application for which the repair is being made. Finally, the finishing material 802 can be sanded and/or scraped to remove all bumps and ridges prior to resurfacing the recreational court 100.

Figure 9:
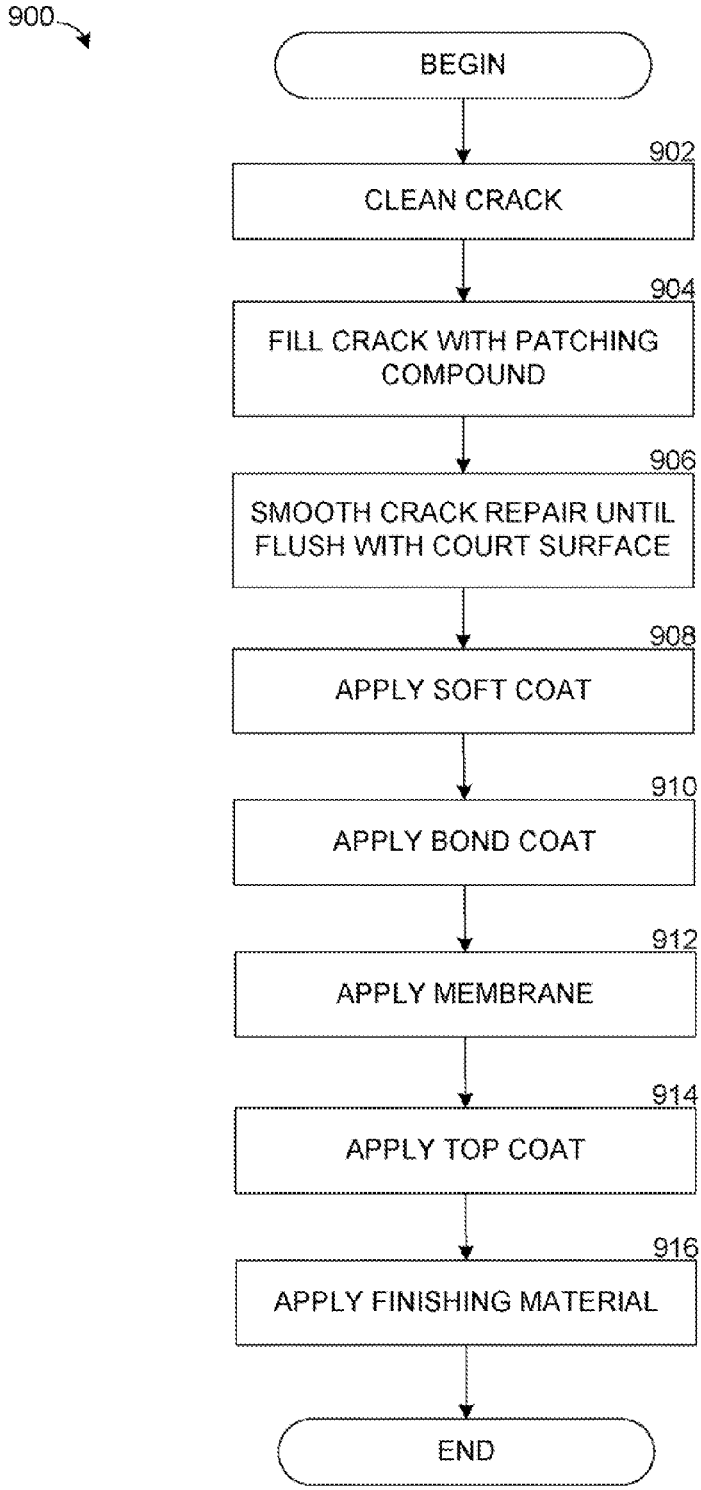
FIG. 9 is a flow diagram, illustrating a method for repairing a crack in a surface according to various embodiments presented herein.

Turning now to FIG. 9, an illustrative routine 900 that provides a concise summary of the process of repairing cracks 106 in recreational courts 100 or other paved surfaces will be described in detail. It should be appreciated that more or fewer operations may be performed than shown in the figures and described herein. These operations may also be performed in a different order than those described herein. The routine 900 begins at operation 902, where the crack 106 is cleaned for repair. At operation 904, the crack 106 is filled with a patching compound 202. As described above, this patching compound 202 may be a latex cement compound, hot pour asphalt, or any other appropriate patching material. After filling the crack 106, at operation 906, the patching compound 202 is scraped and smoothed until it is substantially flush with the top surface 102 of the court.

From operation 906, the routine 900 continues to operation 908, where a soft coat 402 is applied over the filled crack 106. The soft coat 402 may be a chalky coat, such as a mixture of latex polymer and thickener, which creates a non-bonding layer between the patching compound 202 and the membrane 602 to be applied over the soft coat 402. At operation 910, a bond coat 502 is applied to the top surface 102 on both sides of the soft coat 402. This waterproof bond coat 502 will adhere the membrane 602 to the top surface 102 over the top of the soft coat 402 once the top coat 702 is applied over the membrane 602.

After applying the bond coat 502 adjacent to both sides of the soft coat 402, at operation 912, the membrane 602 is rolled out or otherwise applied to the top of the soft coat 402 so that the opposing sides of the membrane 602 adhere to the bond coat 502 previously applied to the top surface 102 of the court. After applying the membrane 602, or simultaneously with the application of the membrane 602, the top coat 702 is applied to the top of the membrane 602 from edge to edge such that the top coat 702 overlaps the edges of the membrane 602 and adheres to the bond coat 502 beneath the membrane 602. As previously discussed, the top coat 702 may be the same material as the bond coat 502. The finishing material 916 is applied in the desired number of coats over the top coat 702, and the routine 900 ends.

Based on the foregoing, it should be appreciated that technologies for providing repairing cracks in paved surfaces such as recreational courts have been disclosed herein. It is to be understood that the invention defined in the appended claims is not necessarily limited to the specific features, configurations, acts, or media described herein. Rather, the specific features, configurations, acts and mediums are disclosed as example forms of implementing the claims.

It should be appreciated that the technology presented herein can be practiced as a system for repairing cracks in paved surfaces such as recreational courts. The system can comprise patching compound, soft coat material, bond coat material, membrane, top coat material, finishing material, or any subset thereof.

It should be appreciated that the technology presented herein can be practiced as one or more methods or processes. Performing the operations of these methods or processes can involve various transformations. For example, a portion of a paved surface can be transformed from a cracked surface to a substantially repaired surface supporting the crack repair system materials discussed herein. Each of the crack repair materials may be transformed in its application to the paved surface. Each of the materials, through its application to the paved surface, can transform the paved surface.

The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

What is claimed is:

1. A method for repairing a crack in a surface, comprising:

filling the crack with a patching compound until the patching compound is substantially flush with the surface;

applying a non-bonding soft coat on the surface over the patching compound;

applying a bond coat to the surface adjacent to opposing edges of the soft coat such that a first strip of bond coat is located on the surface and abutting a first edge of the soft coat, and a second strip of bond coat is located on the surface and abutting a second edge of the soft coat opposite the first edge;

applying a membrane over the soft coat such that opposing edges of the membrane are positioned on the bond coat;

applying a top coat over the membrane such that the top coat overlaps the opposing edges of the membrane and overlays the bond coat; and applying a finishing material over the top coat.

2. The method of claim 1, wherein filling the crack with the patching compound until the patching compound is substantially flush with the surface comprises filling the crack with a latex cement compound to create a filled crack; and scraping or sanding the filled crack until the filled crack is substantially flush with the surface.

3. The method of claim 1, wherein filling the crack with the patching compound until the patching compound is substantially flush with the surface comprises filling the crack with a hot pour asphalt to create a filled crack; and scraping or sanding the filled crack until the filled crack is substantially flush with the surface.

4. The method of claim 1, wherein applying the non-bonding soft coat on the surface over the patching compound comprises applying a liquid mixture of latex polymer and thickener over the patching compound.

5. The method of claim 4, wherein applying the liquid mixture of latex polymer and thickener over the patching compound comprises applying the liquid mixture of latex polymer and thickener in approximately an 8-inch wide coat over the patching compound.

6. The method of claim 1, wherein each of the first strip and the second strip is approximately 12 inches wide.

7. The method of claim 1, wherein applying the bond coat to the surface adjacent to opposing edges of the soft coat comprises applying an elastomeric compound to the surface adjacent to opposing edges of the soft coat such that a waterproof barrier is created by the bond coat.

8. The method of claim 1, wherein applying the membrane over the soft coat such that opposing edges of the membrane are positioned on the bond coat comprises rolling out the membrane such that it is approximately centered on the soft coat and overlapping the bond coat on either side of the soft coat.

9. The method of claim 1, wherein the top coat comprises the same material as the bond coat.

10. The method of claim 9, wherein the material of the top coat and the bond coat comprises an elastomeric compound such that applying the bond coat to the surface adjacent to opposing edges of the soft coat and applying the top coat over the membrane such that the top coat overlaps the opposing edges of the membrane and overlays the bond coat provides a waterproof barrier between the crack and an exterior side of the finishing material.

11. The method of claim 1, wherein applying the finishing material over the top coat comprises applying an acrylic resurfacing compound or latex cement compound over the top coat.

12. The method of claim 1, wherein applying the finishing material over the top coat comprises applying a latex cement patching compound over the top coat.

* * * * *